United States Patent [19]

Lee et al.

[11] Patent Number: 4,689,627

[45] Date of Patent: Aug. 25, 1987

[54] DUAL BAND PHASED ANTENNA ARRAY USING WIDEBAND ELEMENT WITH DIPLEXER

[75] Inventors: Kuan M. Lee, Brea; Nam S. Wong, Fullerton; Ruey S. Chu, Cerritos; Ray Tang, Fullerton, all of Calif.

[73] Assignee: Hughes Aircraft Company, Los Angeles, Calif.

[21] Appl. No.: 496,751

[22] Filed: May 20, 1983

[51] Int. Cl.[4] ..... H01Q 3/22; H01Q 3/24; H01Q 3/26

[52] U.S. Cl. ..... 342/373; 343/776; 343/784; 343/778; 343/853; 333/26; 333/33; 333/126; 333/129; 333/117

[58] Field of Search ..... 333/126, 125, 129, 132, 333/134–137, 110, 117, 26, 21 R, 33, 248, 253; 342/368, 371–373; 343/776–778, 772, 784, 789, 790, 844, 853, 725, 729, 770; 370/37, 36, 123

[56] References Cited

U.S. PATENT DOCUMENTS

| | | | |
|---|---|---|---|
| 3,034,076 | 5/1962 | Tomiyasu | 333/110 |
| 3,101,459 | 8/1963 | Overholser | 333/33 |
| 3,252,113 | 5/1966 | Veltrop | 333/110 |
| 3,324,419 | 6/1967 | Kuroda et al. | 333/24 R |
| 3,431,515 | 3/1969 | Brediger et al. | 333/21 A |
| 3,518,695 | 6/1970 | Schroeder | 342/368 |
| 3,522,610 | 4/1970 | Schroeder | 343/371 |
| 3,555,553 | 1/1971 | Boyns | 343/776 |
| 3,573,835 | 4/1971 | Stark et al. | 343/776 |
| 3,725,824 | 4/1973 | McDonald | 333/21 R |
| 3,758,886 | 9/1973 | Landry et al. | 333/21 R X |
| 3,825,932 | 7/1974 | Hockham | 343/776 |
| 3,942,138 | 3/1976 | Schaedla | 333/21 R |
| 4,029,902 | 6/1977 | Bell, Jr. et al. | 370/123 |
| 4,072,956 | 2/1978 | Provencher | 342/371 X |
| 4,130,823 | 12/1978 | Hoople | 343/768 |
| 4,147,980 | 4/1979 | Rook | 370/37 X |
| 4,231,000 | 10/1980 | Schuegraf | 333/109 |
| 4,240,155 | 12/1980 | Vaughan | 370/37 X |
| 4,375,052 | 2/1983 | Anderson | 333/21 A |

FOREIGN PATENT DOCUMENTS

| | | | |
|---|---|---|---|
| 0675496 | 7/1979 | U.S.S.R. | 333/26 |

OTHER PUBLICATIONS

Laughlin, G. J. et al., "Very Wide-Band Phased-Array Antenna", *IEEE Transaction on Antennas and Propagation*, vol. AP 20, #6, Nov. 1972.

Wheeler, G. J., "Broadband Waveguide to Coax Transition", pub. by Raytheon Manufactig Company, Wayland, Massachusetts, pp. 182–185.

Horkless, E. T. et al., "WT4 Frequency Multiplex System", Int'l Conf. on Millimetric Waveguide Systems, London, England, 9–12, Nov. 1976, pp. 136–139.

"Broad-Band Impedance Matching of Rectangular Waveguide Phased Arrays", by Chao-Chun Chen, IEEE Transactions on Antennas and Propagation, vol. AP-21, No. 3, May 1973 (pp. 298–302).

"Analysis of a Dual-Frequency Array Technique", by R. J. Mailloux and H. Steyskal, IEEE Transactions on Antennas and Propagation, vol. AP-27, No. 2, Mar. 1979, (pp. 130–136).

"Analysis of Interleaved Arrays of Waveguide Elements", by James K. Hsiao, IEEE Transactions on Antennas and Propagation, vol. AP-19, No. 6, Nov. 1971 (pp. 729–735).

*Primary Examiner*—Eugene R. Laroche
*Assistant Examiner*—Benny T. Lee
*Attorney, Agent, or Firm*—Thomas A. Runk; Anthony W. Karambelas

[57] ABSTRACT

A dual band, phased array antenna especially adaptable for tactical radar capable of performing search, track and identification in a hostile jamming environment. The dual band array antenna is essentially two antennas sharing a common antenna aperture. The two antennas possess separate feed system and beam steering control. Thus, the beams for each frequency band can be steered independently and simultaneously. This design utilizes an ultra-wide band radiating element which can operate over approximately an octave bandwidth encompassing two adjacent microwave bands. In particular, the dual band signals can be received efficiently by the radiating element. A dual band coaxial-to-waveguide transition can be used to carry the signals to a diplexer. The dual band signals are separated at the diplexer and can be processed in separate feed networks. The advantages of this dual band phased array technique include not only good impedance characteristics but also the absence of grating lobe formation and cross coupling problems.

15 Claims, 17 Drawing Figures

DUAL BAND PHASED ANTENNA ARRAY USING WIDEBAND ELEMENT WITH DIPLEXER

BACKGROUND

This invention is directed to waveguide array systems, in general, and to dual-band, wideband, shared aperture waveguide systems, in particular.

There are many known methods, devices and systems associated with waveguide systems in general, and radar systems, in particular. For the most part, the known systems and devices are directed to single band arrays which operate on only one frequency signal at a time. These signals may be in the microwave frequency range, e.g., 3.5 $GH_z$ or the like. Typically, the known systems are of a relatively narrow scan capability.

Many of these systems include waveguide devices which are utilized with coaxial cables as the input or output means. In these types of systems, various types of transition devices are used to couple the waveguide to the cable.

In most cases the radar systems include a single band device. That is, the system operates on only one frequency band. Thus, two (or more) array apertures are required in order to process multiple frequencies. In the past, this has caused the multi-frequency systems to have multiple apertures with the attendant increases in cost, weight, size and the like. Thus, these systems have been disadvantageous for utilization in many applications.

Also, in the past, attempts have been made to provide systems wherein a single aperture has been shared by multiple antenna arrays. However, these prior systems were generally of poor quality due to interference and crosscoupling. The best known example of this technique was a twin-dielectric-slab-loaded waveguide array with each frequency band fed by a separate feeding probe as described by Mailloux et al (see Information Disclosure Statement). However, the two signal bands are difficult to isolate and the impedance matching is difficult resulting in relatively high VSWR, e.g. 3:1 or greater.

INFORMATION DISCLOSURE STATEMENT

A search has been conducted and the most pertinent references discovered are included herewith.

U.S. Pat. No. 3,725,824; Woodward; COMPACT WAVEGUIDE-COAX TRANSITION. This patent is directed to a waveguide-to-coaxial cable transition device using a half-height waveguide, a tapered ridge waveguide section, and a 90° coaxial cable connection.

U.S. Pat. No. 3,758,886; Landry et al; VERSATILE IN LINE WAVEGUIDE TO COAX TRANSITION. This patent is directed to a microwave transition device which includes a hook-shaped exciter and a U-shaped dielectric loading transformer.

U.S. Pat. No. 3,431,515; Brediger et al; MICROWAVE TRANSITION APPARATUS. This patent is directed to a microwave transition apparatus which includes a dielectric element shaped to match the impedances of the coax line and waveguide and to provide an asymmetrical load therebetween to alter the propagating wave.

U.S. Pat. No. 4,375,052; Anderson; POLARIZATION ROTATABLE ANTENNA FEED. This patent is directed to a wave polarization rotary section which includes a ridge loaded wave-guide transaction section.

U.S. Pat. No. 4,231,000; Schuegraf; ANTENNA FEED SYSTEM FOR DOUBLE POLARIZATION. This patent is directed to an antenna system for double polarization in two high frequency bands and includes a polarization filter with an antenna and terminal and two directional terminals for circularly polarized waves.

U.S. Pat. No. 4,029,902; Bell, et al; CONTIGUOUS CHANNEL MULTIPLEXER. This patent is directed to a multiplexer for combining a plurality of microwave signal channels for transmission over a common transmission path.

U.S. Pat. No. 3,034,076; Tomiyasu; MICROWAVE DIPLEXER. This patent is directed to an apparatus for coupling (or decoupling) two different frequency microwave signals relative to a single antenna.

U.S. Pat. No. 3,252,113; Veltrop; BROADBAND HYBRID DIPLEXER. This patent is directed to diplexer frequency branching networks.

"BROAD-BAND IMPEDANCE MATCHING OF RECTANGULAR WAVEGUIDE PHASED ARRAYS," Chen, IEEE Trans. Antennas and Propogation, Vol AP-21, No. 3, May 1973, pp. 298–302.

"ANALYSIS OF A DUAL-FREQUENCY ARRAY TECHNIQUE"; Mailloux, et al, IEEE Trans. Antennas and Prop., Vol. AP-27, No. 2, March 1979, pp. 130–136.

"ANALYSIS OF INTERLEAVED ARRAYS OF WAVEGUIDE ELEMENTS," Hsiao, IEEE Trans. Antennas and Prop., Vol. AP-19, No. 6, November 1971, pp 729–735.

No significance is implied by the order of the listing.

SUMMARY OF THE INVENTION

This invention utilizes an open-ended waveguide array which can operate over approximately an octave bandwidth encompassing two adjacent microwave bands. The radiating element is well-matched over an octave in bandwidth for the wide range of scan angles of interest. After the dual band signals are received efficiently by the wide-band radiating element, the signals are separated into the two frequency channels by a diplexer. Separate feed networks are used to process the signals of the two bands. It is shown that a good match can be obtained over the desired bandwidth and scanning range. A desirable dual band transition is included to provide optimal match at both of the frequency bands by fine tuning the matching elements. A diplexer is used with the system to provide the necessary isolation between the two frequency bands.

DESCRIPTION OF A PREFERRED EMBODIMENT

Figure 1:
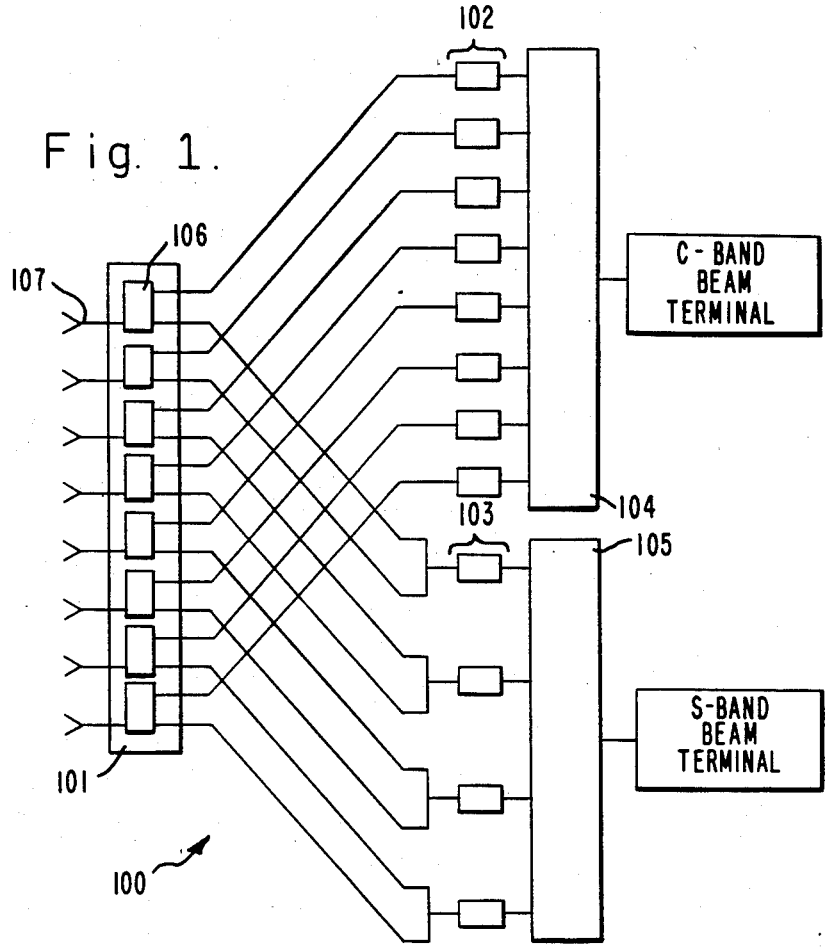
FIG. 1 is a block diagram of a dual band antenna system capable of forming two simultaneously and independently steerable beams.

Referring to FIG. 1, there is shown a block diagram representation of a dual band antenna system 100 which incorporates the teachings of this invention. This system is capable of forming two simultaneously and independently steerable beams. Typically, the system 100 includes a radiating aperture array 101 which is capable of being shared by the two adjacent frequency bands, such as S-band signals and C-band signals. Array 101 includes radiator and dual transitions 107. The array 101 includes a plurality of diplexers 106 connected to a plurality of C-band phase shifters 102 and a plurality of S-band phase shifters 103 in a conventional manner. The respective phase shifters are then connected to the C-band corporate feed 104 and the S-band corporate feed 105. In the S-band feed, block feeding may be used to save the cost of phase shifters and drivers, without causing the formation of grating lobes. Thus, only four S-band phase shifters 103 are required in this embodiment. The corporate feeds are then connected to the C-band and S-band beam terminals, respectively.

Figure 2:
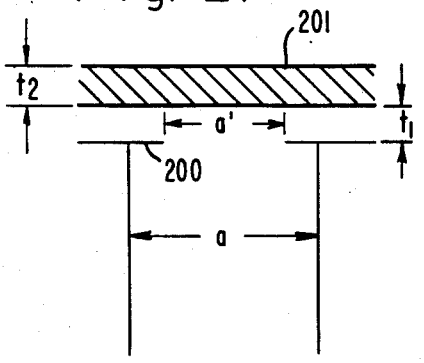
FIGS. 2 and 3 are schematic representations of a radiating structure aperture.

The design concept of the present invention utilizes an ultra-wide bandwidth radiating element which can operate over approximately an octave bandwidth encompassing, for example, both S-band and C-band. In general, it is very difficult to design a well-matched radiating element over an octave in bandwidth for wide scan coverage. However, an open-ended rectangular waveguide element which is suitable for the present application has been designed and is shown schematically in FIG. 2. This waveguide element has an inductive iris 200 loading the aperture. In addition, an impedance matching dielectric radome sheet 201 is provided in front of the waveguide aperture. The geometry of the radiating aperture is suggested in FIG. 2. The impedance characteristics of the radiating element have been determined over a frequency range of 0.6 $f_h$ to 1.0 $f_h$ where $f_h$ is the highest frequency of interest (See FIGS. 5–10). A VSWR of about 2:1 has been achieved as shown by FIGS. 5–10. When the application of the system does not require a good match for the frequencies between the S-band and C-band frequencies, the impedance match at the two discrete S-band and C-band frequencies can be tuned empirically in order to improve performance. The wideband capability of this radiating element has been reported by N. S. Wong, et al, "Investigation of Use of Superimposed Surface Wave Modes", Final Report prepared by Hughes Aircraft Company under contract F 1962-68-C-0185, Report No. AFCRL-70-0183, 1Feb. 1970.

Typical design criteria for the aperture and dielectric randome sheet 201 for the S-band C-band example are set out herewith (with $\lambda_h$ representing the wavelength of the highest frequency in the particular bands of interest):

| | |
|---|---|
| Dielectric Sheet Radome: | Air gap $t_1 = 0.0884\ \lambda_h$ |
| | Sheet thickness $t_2 = 0.0276\ \lambda_h$ |
| | Sheet dielectric constant $\epsilon_r = 7.50$ |

These criteria are discussed in the paper by Chen which is cited in the Information Disclosure Statement. Moreover, as noted above, empirical tuning gives matching techniques for the aperture which can improve on the aperture constructed in accordance with the calculations of Chen or Wong, et al, supra.

Figure 3:
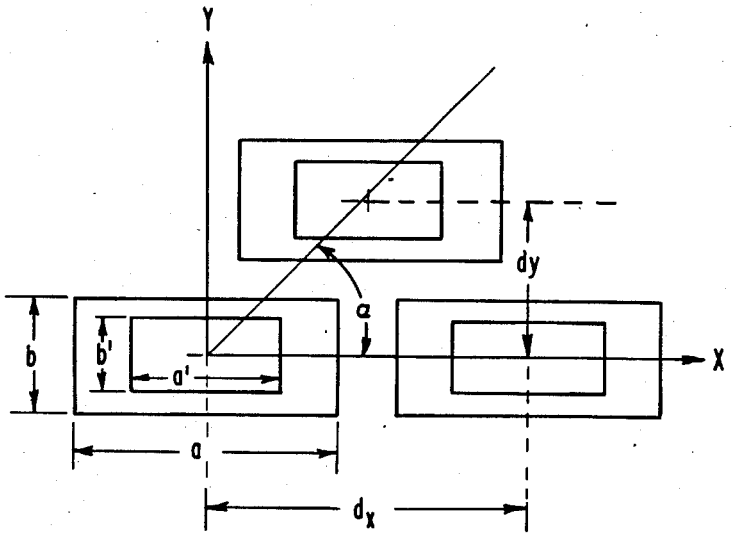

Referring now to FIG. 3, there is shown one example of the geometry of the wideband radiating array aperture of the instant invention. This example of the aperture design is given in terms of wavelength $\lambda_h$ in the following table.

| | |
|---|---|
| Element Spacings: | $d_x = 1.0075\ \lambda_h$ |
| | $d_y = 0.2909\ \lambda_h$ |
| | $\alpha = 30°$ (triangular lattice) |
| Waveguide Dimensions | $a = 0.9720\ \lambda_h$ |
| | $b = 0.1997\ \lambda_h$ |
| | $a' = 0.650\ \lambda_h$ |
| | $b' = b = 0.1997\ \lambda_h$ |

In element spacings, $d_x$ is the horizontal, center-to-center spacing of the array elements; $d_y$ is the vertical center-to-center spacing of the elements; and $\alpha$ is the angle (measured from the horizontal) between the centers of elements in adjacent tiers.

In the waveguide dimensions, a and b are the width and heigth, respectively, of the waveguide; a' and b' are the width and heigth, respectively, of the iris.

In one embodiment of the invention, an array was constructed with the approximate waveguide dimensions:

$a=2.049''$; $a'=1.370''$ $b=b'=0.421''$ and element spacings:

$d_x=2.124''$; $d_y=0.613''$ $\alpha=30°$

This array operated with the approximate S-band (3.0–4.0 $GH_z$), C-band (5.0–6.0 $GH_z$) described herein.

Figure 4:
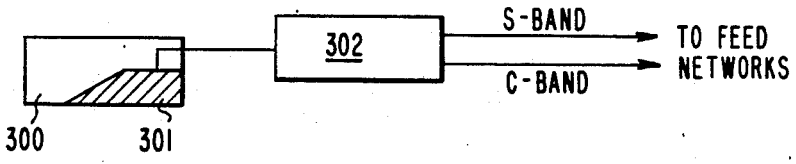
FIG. 4 is a schematic representation of the system of the instant invention.

Referring to FIG. 4, there is shown a schematic representation of a radiating element and corresponding diplexer element employed in the system of the instant invention. In particular, the utilization of the ultra wideband element design for the dual-band, phased array application is illustrated. The dual band signals can be received efficiently by the radiating element 300. A wideband coaxial-to-waveguide transition 301 can be used to carry the signals to a network of suitable configuration (e.g. TEM) so that a diplexer 302 can be constructed easily. The dual band signals are separated at the diplexer 302 and can be processed in separate bands, e.g. S-band and C-band feed networks as indicated in FIG. 4. The advantage of this dual band phased array technique includes not only good impedance characteristics but also the absence of grating lobe formation and the cross-coupling problems of the prior art. Also, this Figure represents the "end-on" configuration which is most useful in a multi-tier multi-element array.

Figure 5:
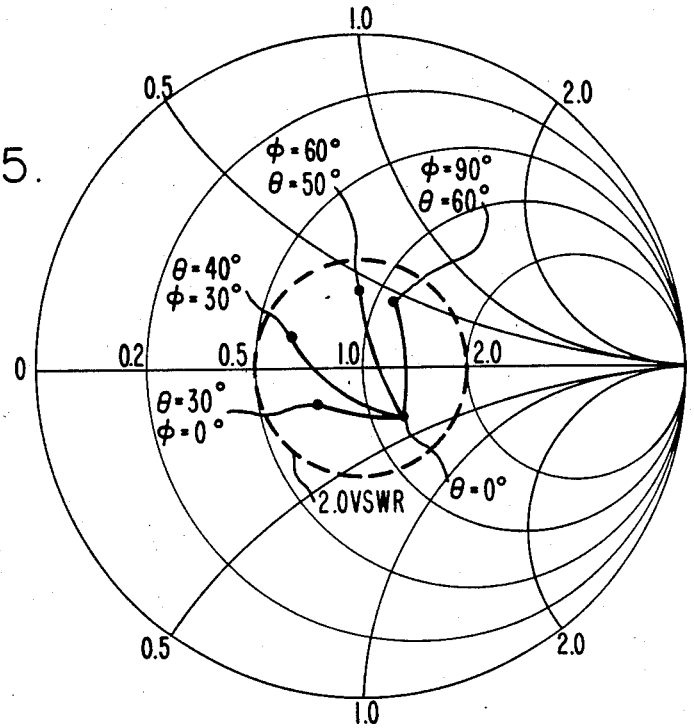
FIGS. 5–10 are Smith charts which show the calculated impedance of the wideband waveguide of the instant invention for different values of $f_H$.
Figure 6:
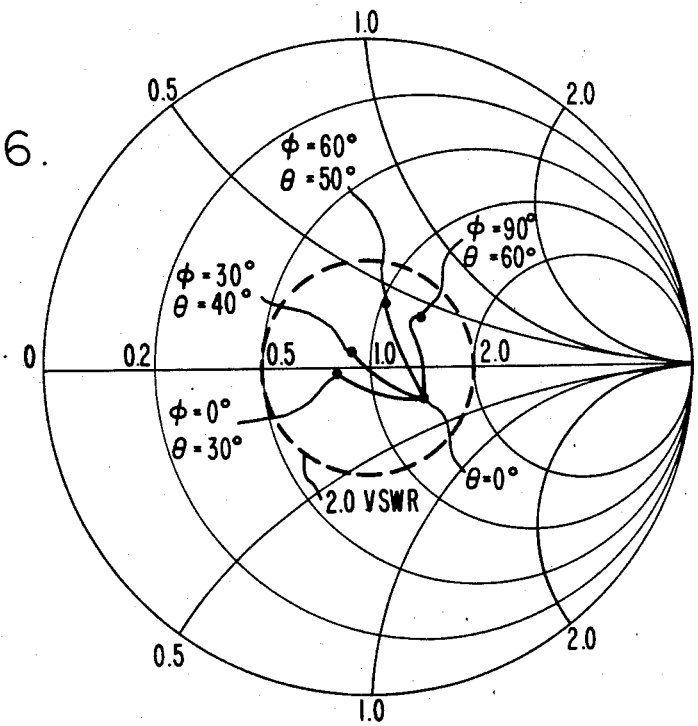
Figure 7:
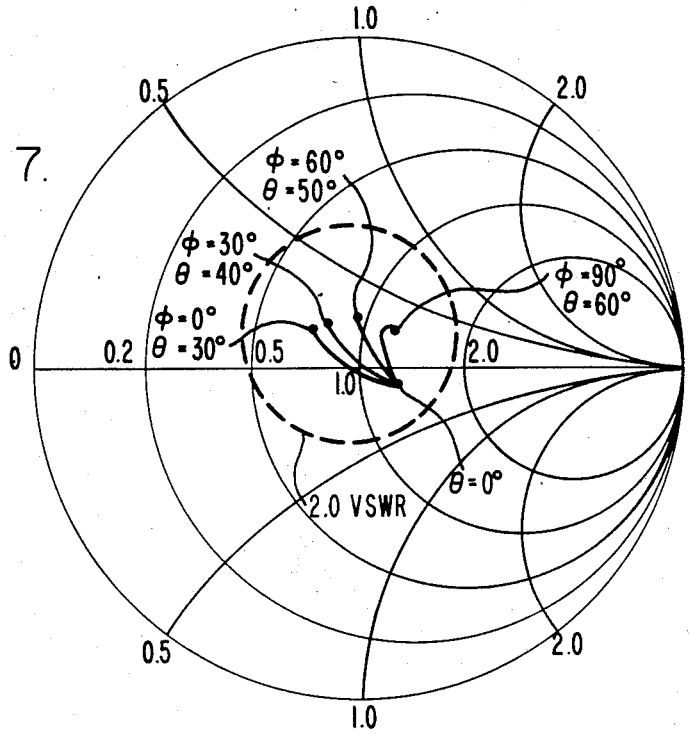
Figure 8:
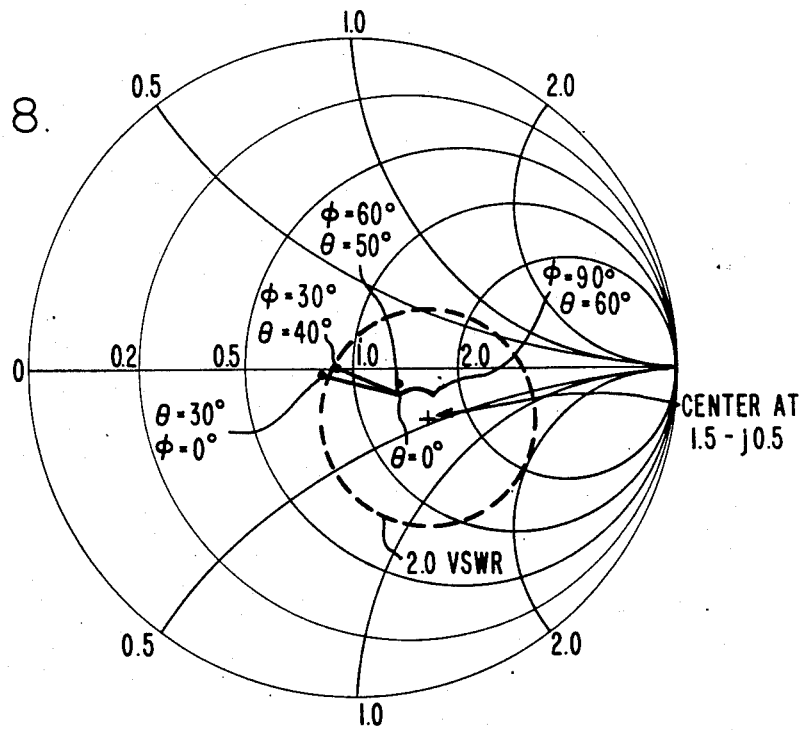
Figure 9:
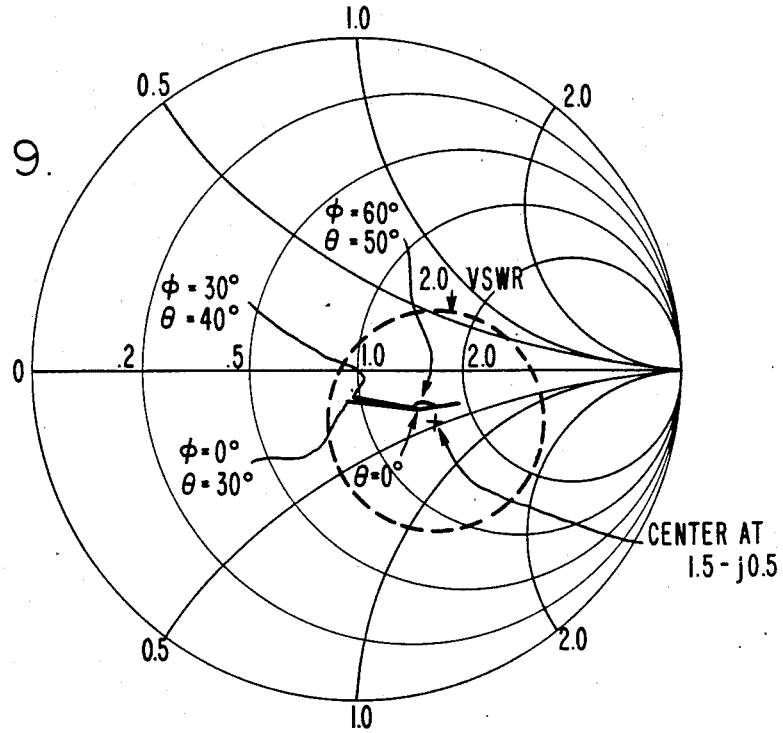
Figure 10:
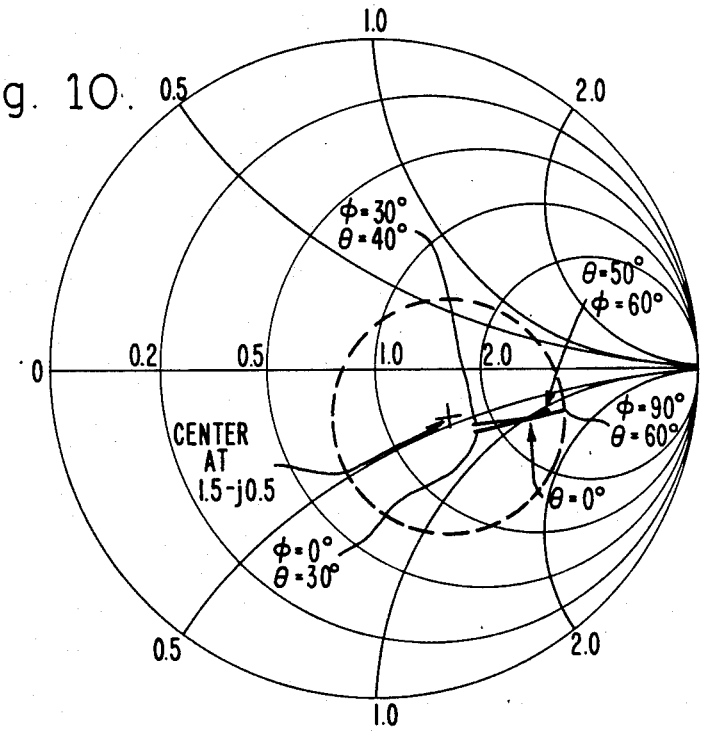

The impedance characteristics of the radiating elements shown in FIG. 3 have been computed and typical admittance characteristics are shown in the Smith charts reproduced in FIGS. 5–10. In particular, at frequency $f=1.0\ f_H$, the radiation admittance of this design as a function of scan coverage is shown in FIG. 5. At frequency $f=0.946\ f_H$, the radiation admittance is shown in FIG. 6. At frequency $f=0.893\ f_H$, the radiation admittance is shown in FIG. 7. At frequency $f=0.643\ f_H$, the radiation admittance is shown in FIG. 8. At frequency $f=0.589\ f_H$, the radiation admittance is shown in FIG. 9. At frequency $f=0.536\ f_H$, the radiation admittance is shown in FIG. 10.

It should be understood that $f_H$ is the highest frequency in the particular bands of interest. Thus, in the preferred embodiment, 1.0 $f_H$=5.60 $GH_z$. From this it can be calculated that:

0.946 $f_H$=5.3 1 $GH_z$; 0.893 $f_H$=5.0 $GH_z$ 0.643 $f_H$=3.6 $GH_z$; 0.589 $f_H$=3.3 $GH_z$ 0.536 $f_H$=3.0 $GH_z$;

From the impedance curves presented in FIGS. 5–10, it is seen that a 2:1 VSWR circle can be drawn around the C-band impedances (for frequencies from 0.893 $f_H$ to 1.0 $f_H$) and for scan angles ($\theta$) from 0° to 60° in the E-plane ($\phi$=90°) and scan angles ($\theta$) from 0° to 30° in the H-plane ($\phi$=0°).

In the low frequency band (from 0.536 $f_H$ to 0.643 $f_H$) and within the same scan range as in the C-band case), it is seen that a 2:1 VSWR circle can be drawn around the impedance data centered at a normalized impedance of 1.5–j0.5. This means that if an internal matching circuit is used to bring the S-band feed line impedance to a value of 1.5–j0.5, then a 2:1 match for the S-band impedances can be obtained.

The basic structure of this invention includes a rectangular waveguide-to-coaxial line transition (see FIG. 4). To obtain a good coupling, the transition is fabricated in a form of big loop instead of a monopole. To suppress the higher order modes generated in the junction, the waveguide heigth is reduced near the probe region. To improve the impedance matching, at least one tuning button is used at some appropriate location.

Figure 11:
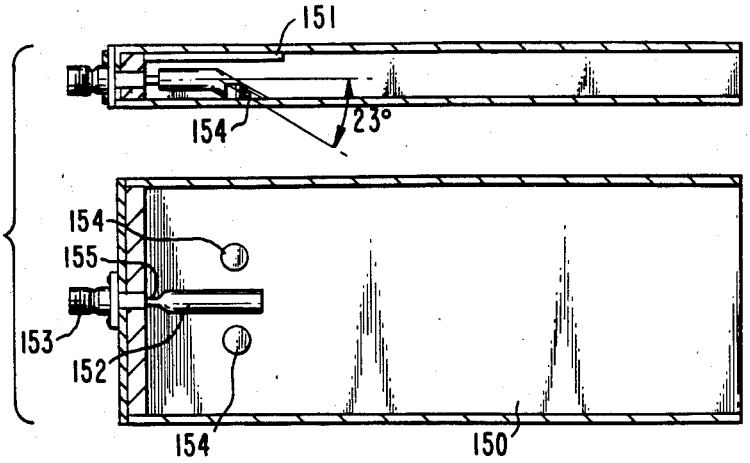
FIGS. 11–13 show different embodiments of coaxial-to-waveguide transitions of the instant invention.
Figure 12:
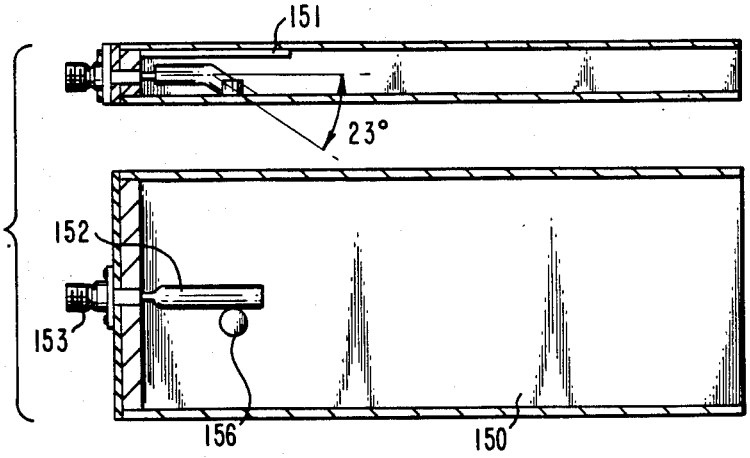
Figure 13:
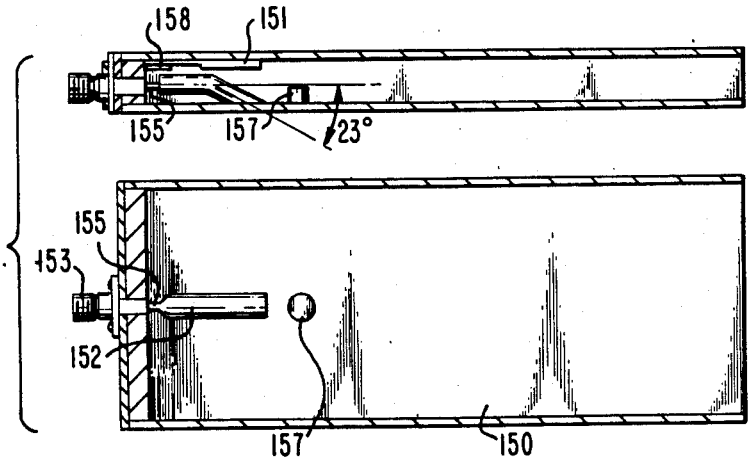
Figure 14:
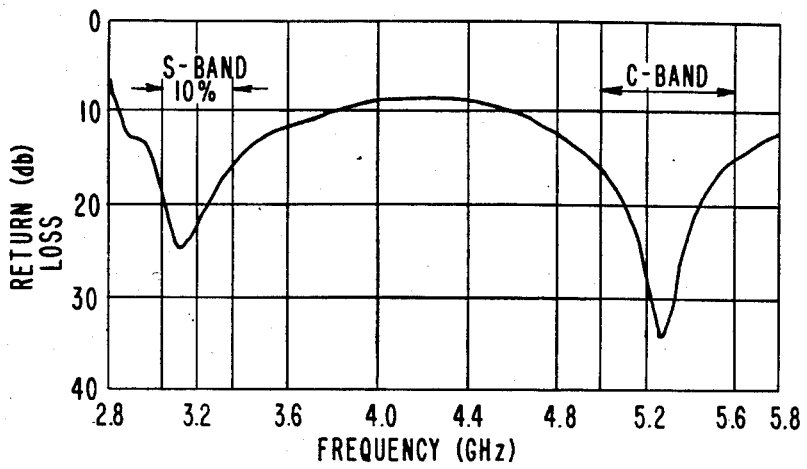
FIGS. 14–16 are charts which show the measured return loss of the transitions shown in FIGS. 11–13, respectively.
Figure 15:
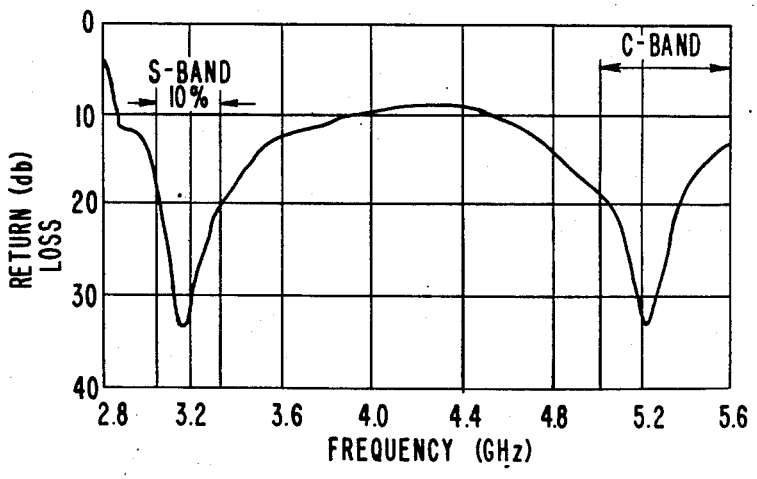
Figure 16:
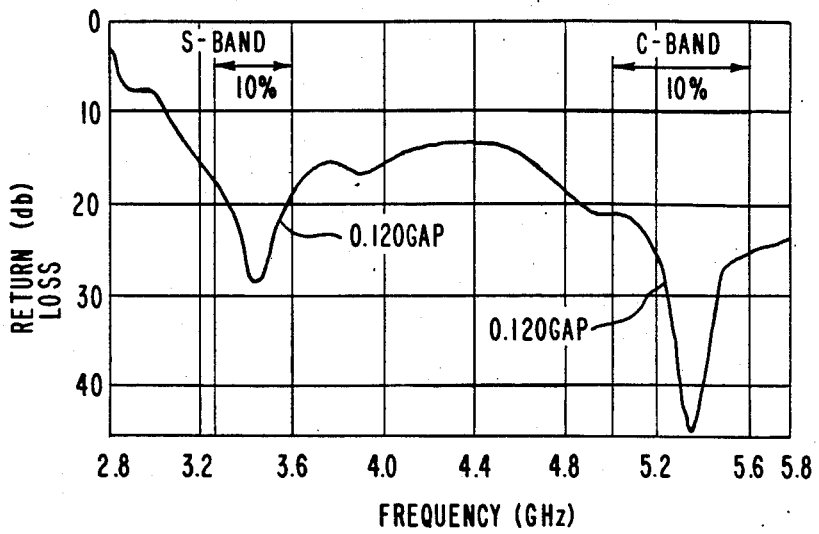

Three transition element configurations capable of the desired performances are shown from the side and the top in FIGS. 11, 12 and 13 together with the corresponding responses which are shown in FIGS. 14, 15 and 16.

The basic configuration consists of a waveguide element 150 with an "end-on" loop transition. A reduced height plate 151 is disposed adjacent one sidewall of element 150. A hook shaped exciter 152 is connected between input port 153 and a second sidewall of element 150. Typically, the first and second sidewalls are opposite, wider walls of the element. At least one tuning button 154 is disposed near the exciter 152 to control the operation of the system.

As shown in FIG. 11, the loop inductance is compensated for by the two buttons 154. These buttons are located on opposite sides of exciter probe 152 and under plate 151 near both sides of the loop. The optimal response is obtained by finding the correct combination of the size of gap 155 near the waveguide-coaxial line transition and the button location In FIG. 12, it is seen that the two small buttons in FIG. 11 can be replaced by one larger button 156 at one side of the probe 152 and under the plate 151. This indicates that as long as the desired susceptance is obtained, the exact form of the circuit component can be varied somewhat.

In FIG. 13, the probe size is the same as in the two previous cases. However, the button 157 is now located at the center of the waveguide housing at some distance away from the end of probe 152 and displaced from the plate 151. An additional tuning effect is obtained by a small plate 158 near the junction area of the waveguide 150 and the coaxial line 153. The combination of this small plate 158 and the size of gap 155 gives the desired tuning effect.

In determining the performance of the transition, the probe 152 dimension and the stepped plate 151 and 158 seem to have the dominant effects. The location of the button (or buttons), in general, controls the fine tuning of the high frequency band. The gap 155 near the waveguide-coaxial-line junction controls the fine tuning of the low frequency band.

For comparisons, the waveguide 150 in each configuration is 6 inches long, 2.2 inches wide and b 0.45 inches high. The probe angle with the sidewall was 23°, the probe 152 extends 1.027 inches from the gap 155 to the end of the probe and is 0.2 inches in diameter. Gap 155 is 0.160 inches, plate 151 is 0.065 inches thick in FIGS. 11 and 12 and 0.080 inches thick in FIG. 13. Plate 158 is 0.040 inches thick and plate 159 is 0.040 inches thick.

Buttons 154 (FIG. 11) are 0.200 inches in diameter, 0.190 inches high, 1.048 inches from the front wall, and 0.854 inches from the respective sidewalls.

Button 156 (FIG. 12) is 0.250 inches in diameter, 0.210 inches high, 1.105 from the front wall, and disposed alongside the probe 152.

Button 157 (FIG. 13) is 0.200 inches in diameter, 0.180 inches high, 1.340 inches from the frontwall, and 1.10 inches from each side wall.

FIGS. 14–16 show the characteristics for the measured return loss of the coaxial-to-waveguide transition for the respective configurations shown in FIGS. 11–13.

Figure 17:
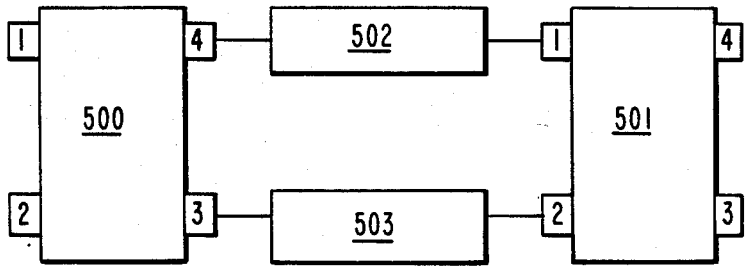
FIG. 17 is a block diagram of a diplexer configuration used with the instant invention.

In the wideband diplexer design used with this invention, several options have been considered. For example, printed diplexer circuit designs are possible. One technique is to use a 1:2 power divider and two different bandpass filters, one for 3.0–3.6 GHz band pass and the other for 5.0–5.6 GHz band pass. A second technique is to use a 1:2 power divider, one high pass filter for bands above 4.3 GHz and a low pass filter for bands below 4.3 GHz. The simplest and most effective way of constructing an effective wideband diplexer is shown in FIG. 17. This diplexer consists of a pair of wideband hybrid couplers 500 and 501 and two low pass filters 502 and 503, all of conventional design. The low pass filters divide the frequencies of the signals applied to the diplexer and the hybrid couplers insure the isolation and good impedance matching. A typical low pass filter, based on conventional design can be made using a microstrip line.

The operation of the preferred arrangement of FIG. 17 is described. If the $f_H$ and $f_L$ signals (high and low frequency signals) are provided as an input at port 1 of wideband coupler 500, half of the power goes to port 3 and half of the power goes to port 4. These two halves of the signals are at quadrature phase. The high frequency signals will be reflected back by the two low pass filters 502 and 503. Thus, these high frequency signals will be added in-phase at port 2 and completely cancelled at port 1. Thus, port 2 of coupler 500 is the output port for high frequency signals.

Conversely, the low frequency signals will be transmitted through the two low pass filters and will be added in phase at port 3 of coupler 501 and completely cancelled at port 4. Thus, the output port for low frequency signals is at port 3 of coupler 501. Port 1 of coupler 500 is, therefore, defined as the input port, port 2 of coupler 500 is defined as the C-band channel, port 3 of coupler 501 is defined as the S-band channel, and port 4 of coupler 501 is defined as the isolation port (or dummy load). This type of diplexer is highly useful with the system of the instant invention.

Thus, there has been shown a preferred embodiment of a dual band phased array antenna with wideband waveguide elements. For purposes of explanation a preferred embodiment has been described in detail. However, it must be understood that modifications to the described embodiment can be made. Moreover, the dual band array is not limited to S-band and C-band operation. Typically, any pair of adjacent bands can be accomodated by appropriate scaling of the elements. It must be recognized that any modifications which fall within the purview of this description are intended to be included therein as well. That is, this description is intended to be illustrative only and is not intended to be limitative of the invention. The scope of the invention is limited only by the claims appended hereto.

We claim:

1. A dual band antenna for operating over first and second distinct frequency bands, comprising, waveguide means having a wideband aperture therein for operation over said first and second frequency bands, at least two feed networks for operating on respective signals in said respective frequency bands, diplexer means coupled between said networks and said waveguide means and adapted to receive the signals in said respective first and second frequency bands at respective first and second input ports and to produce output signals representative of the distinct frequencies; and wideband transition means coupled between said diplexer means and said waveguide means for operating over said first and second distinct frequency bands;

wherein said diplexer means is coupled to said wideband transition means via coaxial cable.

2. A dual band antenna for operating over first and second distinct frequency bands, comprising, waveguide means having a wideband aperture therein for operation over said first and second frequency bands, at least two feed networks for operating on respective signals in said respective frequency bands, diplexer means coupled between said networks and said waveguide means and adapted to receive the signals in said respective first and second frequency bands at respective first and second input ports and to produce output signals representative of the distinct frequencies, and wideband transition means coupled between said diplexer means and said waveguide means for coupling signals operating over said first and second distinct frequency bands, wherein said transition means couples said diplexer means to said waveguide means in an end-on arrangement.

3. The antenna recited in claim 2 wherein said transition means includes a portion of said waveguide means and comprises:

a hook shaped exciter probe connected from an input port of said waveguide means to a first side wall of said waveguide means, plate means disposed within said waveguide means adjacent a second side wall of said waveguide means and between said exciter probe and said second side wall, and button means disposed within said waveguide means adjacent said exciter probe as to control the frequency characteristics of said waveguide means.

4. The antenna recited in claim 3 wherein, said button means include a pair of buttons disposed adjacent opposite sides of said exciter probe and under said plate means.

5. The antenna recited in claim 3 wherein, said plate means is a single rectangular plate means.

6. The antenna recited in claim 3 wherein, said plate means includes areas of different thickness.

7. An antenna array for an array radar system operating over first and second distinct frequency bands, comprising:

wideband array aperture comprising a plurality of contiguous waveguide elements and a matching dielectric radome, said wideband aperture for operation over said first and second frequency bands;

first and second feed networks for operating on respective signals in said first and second frequency bands;

a plurality of diplexer elements, one for each of said waveguide elements, for coupling said respective waveguide elements to said first and second networks, said diplexer elements comprising first and second feed ports for coupling to the respective first and second feed networks and a third port for coupling to a respective one of said waveguide elements; and a plurality of wideband transition elements, one for each of said waveguide elements for coupling between respective ones of said waveguide elements and said third port of respective ones of said diplexer elements in an end-on arrangement.

8. The antenna array of claim 7 wherein said transition elements comprise waveguide-to-coaxial line transition members, which are connected to said respective diplexer third ports by coaxial cables.

9. The antenna array of claim 7 wherein said respective transition element comprises a portion of a corresponding one of said waveguide elements and comprises:

a hook shaped probe connected from an input port of said waveguide element to a first side wall of said element;

plate means disposed within said element adjacent a second side wall of said element and between said exciter probe and said second side wall; and button means disposed within said waveguide element adjacent said exciter probe so as to control the frequency characteristics of said transition and waveguide elements.

10. The antenna array of claim 9 wherein said respective transition elements are tuned for low return loss operation in both of said first and second frequency bands.

11. The antenna array of claim 10 wherein said button means includes a pair of buttons disposed adjacent opposite sides of said exciter probe and under said plate means.

12. A dual band antenna for operating over first and second distinct frequency bands, comprising:

waveguide means having a wideband aperture therein for operation over said first and second frequency bands;

at least two feed networks for operation on respective signals in said respective frequency bands;

diplexer means coupled between said networks and said waveguide means and adapted to receive the signals in said respective first and second frequency bands at respective first and second input ports and to produce output signals representative of the distinct frequencies; and wideband transition means coupled between said diplexer means and said waveguide means in an end-on arrangement for coupling output signals operating over said first and second distinct frequency bands, and transition means including a portion of a waveguide element and comprising:

a hook shaped exciter probe connected from an input port of said element to a first side wall of said element;

plate means disposed within said element adjacent a second side wall of said element and between said exciter probe and said second side wall; and button means disposed within said element adjacent said exciter probe so as to control the frequency characteristics of said element, said means including a pair of buttons disposed adjacent opposite sides of said exciter probe and under said plate means.

13. A dual band antenna for operating over first and second distinct frequency bands, comprising:

waveguide means having a wideband aperture therein for operation over said first and second frequency bands;

at least two feed networks for operation on respective signals in said respective frequency bands;

diplexer means coupled between said networks and said waveguide means and adapted to receive the signals in said respective first and second frequency bands at respective first and second input ports and to produce output signals representative of the distinct frequencies; and wideband transition means coupled between said diplexer means and said waveguide means in an end-on arrangement for coupling output signals operating over said first and second distinct frequency bands, said transition means including a portion of a waveguide element and comprising:

a hook shaped exciter probe connected from an input port of said element to a first side wall of said element;

plate means disposed within said element adjacent a second side wall of said element and between said exciter probe and said second side wall; and button means disposed within said element adjacent said exciter probe so as to control the frequency characteristics of said element, said means including a single button disposed adjacent an end of said exciter probe and displaced from said plate means.

14. An antenna array for an array radar system operating over first and second distinct frequency bands, comprising:

wideband array aperture comprising a plurality of contiguous waveguide elements and a matching dielectric radome, said wideband aperture for operation over said first and second frequency bands;

first and second feed networks for operation on respective signals in said first and second frequency bands;

a plurality of diplexer elements, one for each of said waveguide elements, for coupling said respective waveguide elements to said first and second networks, each of said diplexer elements comprising first and second feed ports for coupling to the respective first and second feed networks and a third port for coupling to a respective one of said waveguide elements; and a plurality of wideband transition elements, one for each of said waveguide elements for coupling between respective ones of said waveguide elements and said third port of respective ones of said diplexer elements in an end-on arrangement, said transition elements tuned for low return loss operation in both of said first and second frequency bands and comprising:

a hook shaped probe connected from an input port of said waveguide element to a first side wall of said element;

plate means disposed within said element adjacent a second side wall of said element and between said exciter probe and said second side wall; and button means disposed within said waveguide element adjacent said exciter probe so as to control the frequency characteristics of said transition and waveguide elements, said means including a single button disposed adjacent one side of said exciter probe and under said plate means.

15. An antenna array for an array radar system operating over first and second distinct frequency bands, comprising:

wideband array aperture comprising a plurality of contiguous waveguide elements and a matching dielectric radome, said wideband aperture for operation over said first and second frequency bands;

first and second feed networks for operation on respective signals in said first and second frequency bands;

a plurality of diplexer elements, one for each of said waveguide elements, for coupling said respective waveguide elements to said first and second networks, each of said diplexer elements comprising first and second feed ports for coupling to the respective first and second feed networks and a third port for coupling to a respective one of said waveguide elements; and a plurality of wideband transition elements, one for each of said waveguide elements for coupling between respective ones of said waveguide elements and said third port of respective ones of said diplexer elements in an end-on arrangement, said transition elements tuned for low return loss operation in both of said first and second frequency bands and comprising:

a hook shaped probe connected from an input port of said waveguide element to a first side wall of said element;

plate means disposed within said element adjacent a second side wall of said element and between said exciter probe and said second side wall; and button means disposed within said waveguide element adjacent said exciter probe so as to control the frequency characteristics of said transition and waveguide elements, said means including a single button disposed adjacent an end of said exciter probe and displaced from said plate means.

* * * * *